US005548869A

United States Patent [19]

Ryczek

[11] Patent Number: 5,548,869

[45] Date of Patent: Aug. 27, 1996

[54] ADJUSTABLE PIVOT DOOR ASSEMBLY

[75] Inventor: William F. Ryczek, Bristol, Conn.

[73] Assignee: Arthur Cox & Sons, Inc., City of Industry, Calif.

[21] Appl. No.: 220,742

[22] Filed: Mar. 31, 1994

[51] Int. Cl.[6] ..... E05D 15/26; E05D 7/04

[52] U.S. Cl. ..... 16/93 R; 16/235; 16/249; 160/203

[58] Field of Search ..... 16/235, 249, 378, 16/379, 381, 2, 93 R; 160/203–206, 208; 248/221.4, 535; 403/108, 326; 24/584, 585

[56] References Cited

U.S. PATENT DOCUMENTS

| | | | |
|---|---|---|---|
| 3,683,453 | 8/1972 | McLeland et al. | 160/206 |
| 3,866,658 | 2/1975 | Smith | 160/206 |
| 3,957,102 | 5/1976 | Kempel | 16/93 R |
| 4,106,158 | 8/1978 | Kellems et al. | 16/129 |
| 4,109,346 | 8/1978 | Strozier | 160/206 |
| 4,386,646 | 6/1983 | Matyas | 160/206 |

OTHER PUBLICATIONS

Acme & Stanley catalog, 1986, product sheet for Fold–A-side bi–fold door hardware.

*Primary Examiner*—M. Rachuba

*Assistant Examiner*—Kenneth J. Hansen

*Attorney, Agent, or Firm*—Knobbe, Martens, Olson & Bear

[57] ABSTRACT

A pivot assembly employs a pivot block to resist lateral forces and facilitate door alignment. The assembly includes a sleeve, pivot pin, pivot block and jamb bracket. The jamb bracket is connected to a corner between a jamb and a floor. The pivot block mounts on to the jamb bracket with anchors that engage serrations in a slot of the jamb bracket. The pivot block includes two halves resiliently connected at one end and separated by a gap, with a conical socket centered along the gap. A pivot pin is threaded into a sleeve mounted to the lower edge of a door to adjust height. A head on the lower end of the pin engages grooves in the pivot block socket. The pivot block halves separate to accommodate the pivot pin, and to cause the pivot block halves to be anchored in the jamb bracket. To properly align the door, the door is lifted to disengage the pivot pin from the pivot block. Vertical height is adjusted by rotating the pivot pin in the sleeve. Horizontal adjustments are made by pinching or squeezing the pivot block halves in order to slide it along the jamb bracket slot.

22 Claims, 3 Drawing Sheets

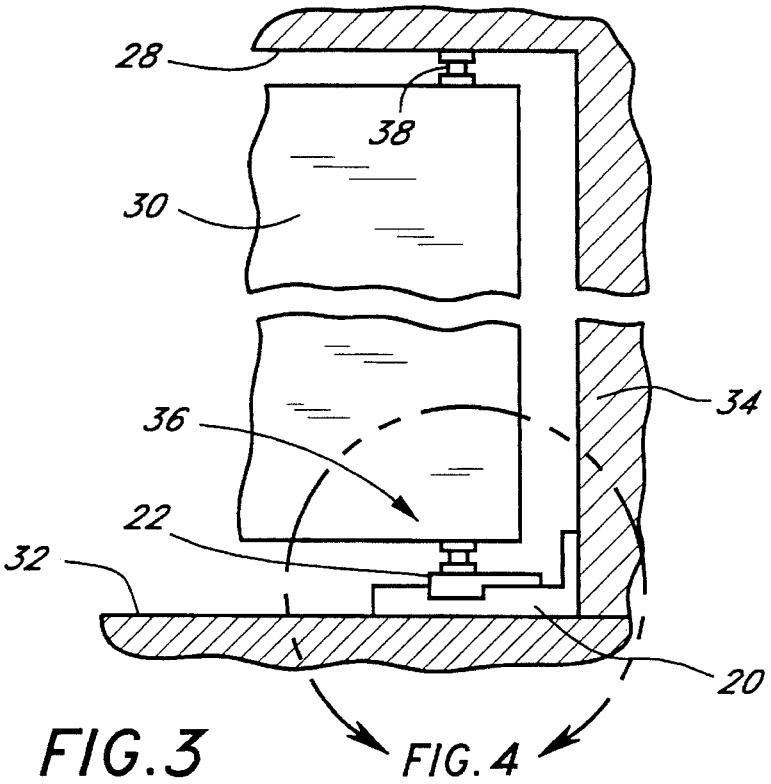
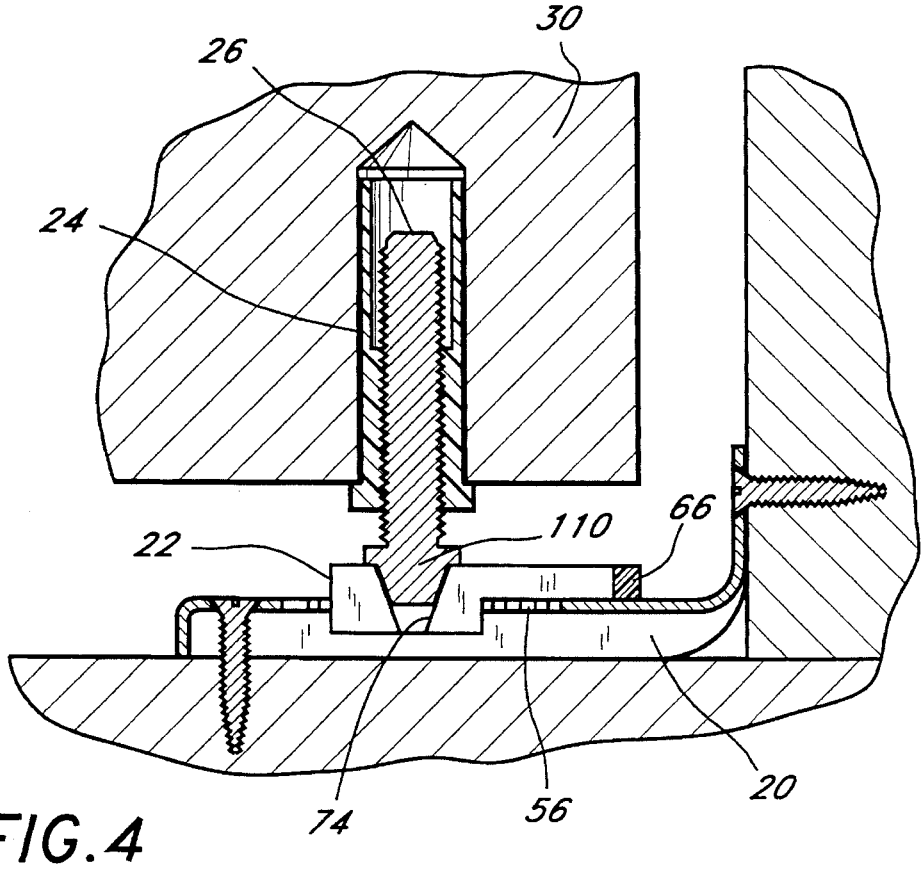
FIG. 4

ADJUSTABLE PIVOT DOOR ASSEMBLY

BACKGROUND OF THE INVENTION

The invention relates generally to swinging and folding door pivot devices, and, more particularly, to lower pivot assemblies having structures that exhibit improved tolerance to lateral forces. The invention further relates to a method of using such pivot devices.

Swinging and folding doors are commonly mounted adjacent to a door jamb by way of pivots at the top and bottom. In general, pivot structures utilize an upper pivot assembly mounted on an upper track and a lower pivot assembly mounted to the floor. Commonly, the lower pivot assembly provides both vertical and horizontal adjustment for alignment of the door within the door jamb. A variety of differing approaches exist to implement the lower pivot assembly. In one variant, the lower pivot assembly comprises an interlocking pivot pin and jamb bracket. In another variant, a pivot block is placed between the pivot pin and the jamb bracket.

Generally it is desirable for the lower pivot assembly to resist a variety of lateral forces exerted on the door. Greater resistance to lateral forces ensures against slippage of the pivot pin or pivot block within the jamb bracket and deters misalignment or disconnection of the pivot assembly. It is also desirable to provide convenient vertical and horizontal adjustments. The ability to adjust vertical door height allows modifications for carpet thickness and differing door frame sizes. The ability to make horizontal adjustments allows alignment of the door within the door frame.

For example, U.S. Pat. No. 3,866,658 describes a lower pivot assembly for a door which permits both vertical and horizontal adjustments. However, adjustments are somewhat difficult and require the use of tools. Adjustment of the door height is provided by a threaded pin and an adjustment nut that, upon rotation of the pin by a wrench, adjusts vertical height. To adjust the pivot block horizontally, the pivot block must be removed from the jamb bracket. The pivot block is then reinserted at a new horizontal position. Therefore, such an arrangement calls for use of a wrench to adjust the vertical door height and removal of the pivot block to adjust the horizontal pivot position.

In U.S. Pat. No. 4,106,158, the pivot pin has teeth thereon which engage complementary teeth on the jamb bracket. Both vertical and horizontal positioning are controlled by altering the pivot pin. Vertical adjustment is achieved by rotating the pivot pin. Horizontal adjustment is achieved by lifting the pin out of the jamb bracket and reinserting it at a desired location. In the preferred form, the teeth are tapered downwardly and inwardly such that they can disengage during the normal operation of the door. More specifically, if something is blocking the door when attempting to close it, the lateral force generated can cause the pivot pin and the door to move upwardly. Such an upward movement may separate the pivot pin from the jamb bracket. As a result, the pin and the door may move horizontally out of alignment.

Thus, a need exists for a vertically and laterally adjustable lower pivot assembly that prevents undesired lateral movement of the assembly.

SUMMARY OF THE INVENTION

In accordance with the present invention, the lower pivot assembly comprises a sleeve connectable to the bottom of a door, a pivot pin in the sleeve, a pivot block for adjusting horizontal position, and a jamb bracket mounted to the floor. The L-shaped jamb bracket connects to a lower corner between the jamb and the floor. An elongated slot is provided within a portion of the bracket parallel to the floor. A notch, and a plurality of serrations are positioned along each elongated edge of the slot.

The pivot block comprises two halves resiliently connected at one end and separated by a gap. Preferably, the two halves are connected with a V-shaped resilient portion to form a narrow gap. The inside wall of each block half forms the gap. The gap allows expansion or contraction of the pivot block width. Thus, lateral, inward pressure exerted on the outside of each block half flexes the V-shaped resilient connection and squeezes or pinches the two block halves together. Once the pressure is released, the flexed V-shaped resilient connection expands the two halves to their original position. In addition, a frusto-conical socket is centered along the gap. The socket is formed by locating a recess on the inside wall of each block half. The recesses align to create the socket. Therefore, the width of the socket is limited by the width of the gap. When the two halves are pinched together the width of the circular socket decreases.

The preferred pivot block also includes a plurality of feet, side wings, and anchors. At least one foot, side wing and anchor exists on each block half. Each anchor depends from beneath the bottom face of a block half. Each anchor has serrations that extend latterly outward, complementary to serrations on the jamb bracket. Also, each foot depends from beneath the bottom face of a block half. Each foot has a protrusion that extends laterally outward and is adapted for insertion into the notch on the jamb bracket. Once inserted into the jamb bracket, the feet prevent accidental removal of the pivot block. Each side wing is positioned on the outside wall of a block half and is adapted to overhang an edge of the jamb bracket. The wings and feet help prevent twisting of the pivot block within the jamb bracket and help guide the pivot block translationally along the jamb bracket.

A sleeve adapted for mounting in a door, and a pivot pin with interengaging threads are positioned such that the pivot pin is vertically adjustable relative to the door by rotation of the pivot pin within the sleeve. The pivot pin has an enlarged, generally conical head, such that the head has the appearance of a beveled gear. The conical head points downward so that the lower portion of the head is narrower than the upper portion. In addition, a plurality of splines extend along the length of the head.

In operation, the pivot block is inserted into the jamb bracket and positioned for proper horizontal alignment. The pivot block is positioned by pinching the side wings and sliding the pivot block to a proper location. Once the pivot block is released, the two block halves separate until the anchors loosely engage the serrations in the jamb bracket. For vertical height, the pivot pin is rotated within the sleeve and then inserted into the circular socket of the pivot block. The pivot pin exerts a downward force that corresponds to the weight of the door. The socket translates the downward force generated by the weight of the door into lateral forces that expand the gap in the pivot block. Thus the pivot block halves separate to accommodate the pivot pin and to firmly secure the anchors to the jamb bracket slot. Advantageously, the pin is captured in the socket because the pin head diameter is greater than said gap.

In accordance with the method of the invention, a jamb bracket is fastened to a door jamb and a pivot block is then inserted into the jamb bracket. The pivot block is then positioned for proper door alignment. Furthermore, a sleeve is connected to the lower portion of a door. A threaded pivot pin is then rotated into the sleeve. Rotating the pivot pin allows adjustment of the door height. The pivot pin is then inserted into the pivot block so that the pivot block expands to accommodate the pivot pin. The expanding pivot block then firmly engages the jamb bracket. In addition, the pivot block can be interlocked with the jamb bracket to inhibit removal of the pivot block. The pivot block can also be squeezed or pinched to facilitate the positioning of said pivot block within the jamb bracket.

BRIEF DESCRIPTION OF THE DRAWINGS

Other aspects, advantages and novel features of the invention will become apparent upon reading the following detailed description of the invention and upon reference to the accompanying drawings in which:

FIG. 3 is a schematic, partially sectionalized view illustrating the lower pivot assembly mounted in a door frame and connected to a door;

FIG. 4 is a cross-sectional side view of the lower pivot assembly showing all parts interconnected.

Figure 1:
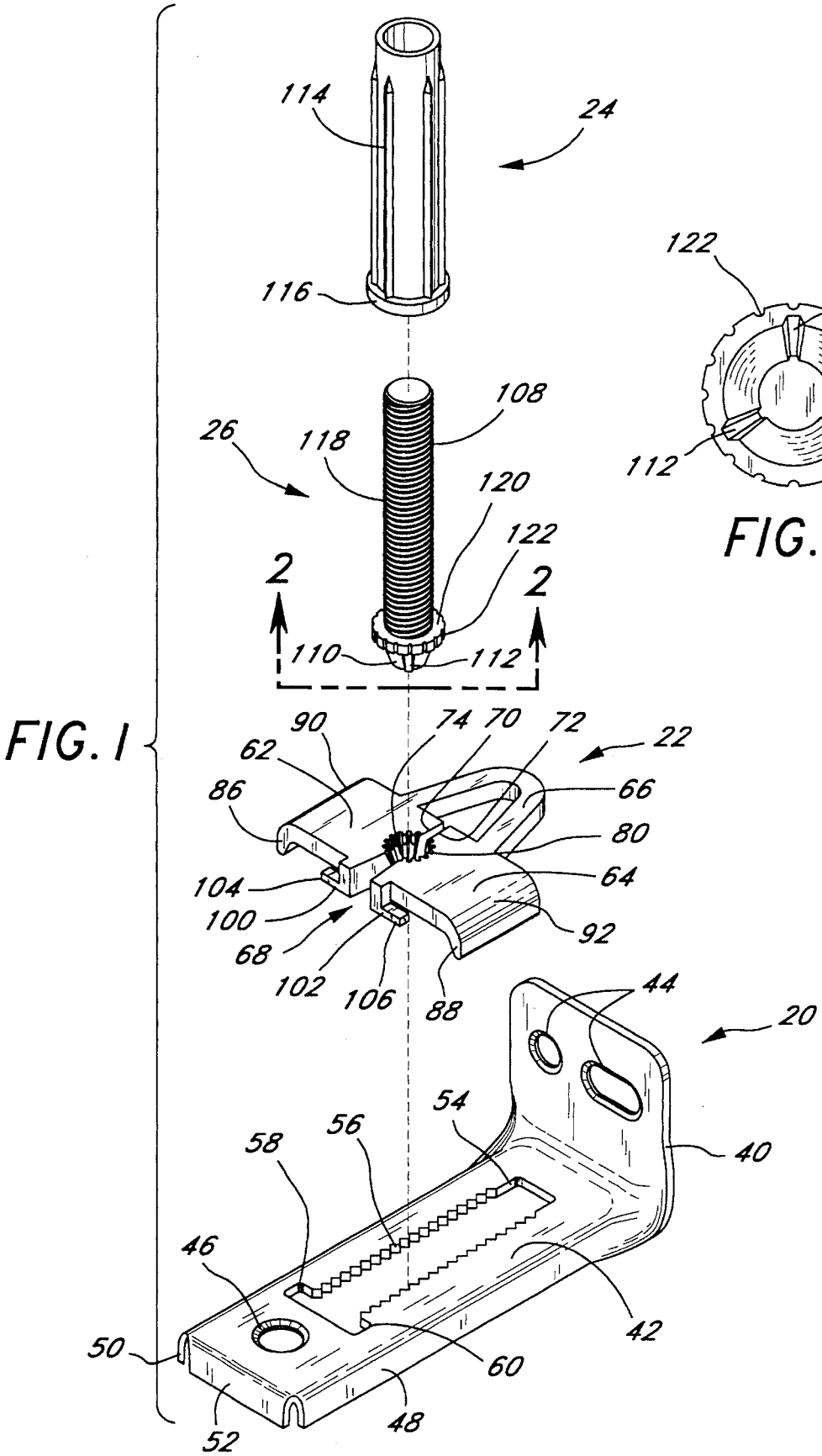
FIG. 1 is an exploded perspective view of the improved lower pivot assembly according to this invention.

While the invention is susceptible to various modifications and alternative forms, specific embodiments thereof are shown by way of example in the drawings and will herein be described in detail. It should be understood, however, that the drawings and description thereto are not intended to limit the invention to the particular forms disclosed, but on the contrary, the intention is to cover all modifications, equivalents and alternatives falling within the spirit and scope of the present invention defined by the appended claims.

DETAILED DESCRIPTION OF THE PREFERRED EMBODIMENT

Referring to FIG. 1, a lower pivot assembly according to the present invention includes a jamb bracket 20, a pivot block 22, a sleeve 24 connectable to the bottom of a door, and a pivot pin 26 in the sleeve 24. FIG. 3 illustrates an implementation of the lower pivot assembly in a door 30 mounted within a door frame 28. The door is mounted to the lower pivot assembly 36 and an upper pivot 38. Thus, the door can swing about the two pivots 36 and 38. FIG. 3 shows that the jamb bracket 20 is mounted in a lower corner between the floor 32 and the door jamb 34. Referring to FIG. 4, the pivot block 22 rests in the jamb bracket 20 and holds the pivot pin 26. The pivot pin 26 is threaded into a sleeve 24 which is connected to the door 30. Since this invention concerns the structure of the lower pivot assembly additional details of the upper pivot and door structure which will be apparent to one skilled in the art are not set forth herein.

The generally L-shaped jamb bracket 20 shown in FIG. 1, has a vertical wall 40 and an elongated horizontal portion 42 that runs parallel to the floor. Two screw holes 44 are provided on the vertical wall 40 so that the jamb bracket 20 can be connected to a door jamb. Similarly, the horizontal portion 42 has a screw hole 46 for securing the jamb bracket 20 to the floor. In other embodiments, three or more screw holes may be provided in the vertical wall 40 to secure jamb bracket 20 to the door jamb. An end 52 and the two elongated edges 48 and 50 are flanged downward so that the horizontal portion 42 stands above the floor, and provides a clearance space beneath the bracket. In the preferred embodiment, the jamb bracket is made of metal.

The horizontal portion 42 has a rectangular, elongated slot 54 extending along its length, so that when mounted, the slot 54 extends away from the door jamb, parallel to the floor. Positioned along the inside sides of the slot 54 are a plurality of evenly spaced serrations 56. The serrations 56 extend laterally inward towards the center of the slot. In addition, to the serrations 56, the slot 54 has two notches 58 and 60. Each notch is positioned opposite to the other and extends laterally outward from the slot center. In the preferred embodiment, the notches are located close to the corners of the slot away from the door jamb.

FIGS. 1, and 5 through 7 illustrate the pivot block. The pivot block is preferably made of a synthetic, resilient material such as reinforced nylon. However, other suitable materials may include those sold under the trademarks Acetal and Delrin 500, as well as glass reinforced nylon, or silicon. The pivot block comprises two halves 62 and 64 joined at one end by a resilient or spring connection 66 preferably having a V-shape, as shown.

The inside walls 70 and 72 of each block half are separated by gap 68, which allows expansion or contraction of the pivot block width. Thus, lateral, inward pressure exerted on the outside of each block half 62 and 64 flexes the V-shaped resilient connection 66 and squeezes or pinches the two block halves together. Once the pressure is released, the flexed V-shaped resilient connection 66 expands the two block halves 62 and 64 to their original position.

Figure 5:
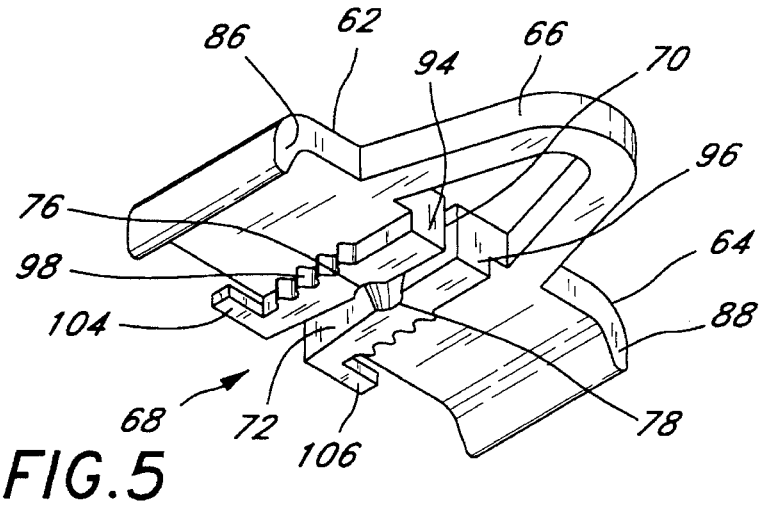
FIG. 5 is a perspective, bottom view of the pivot block.
Figure 6:
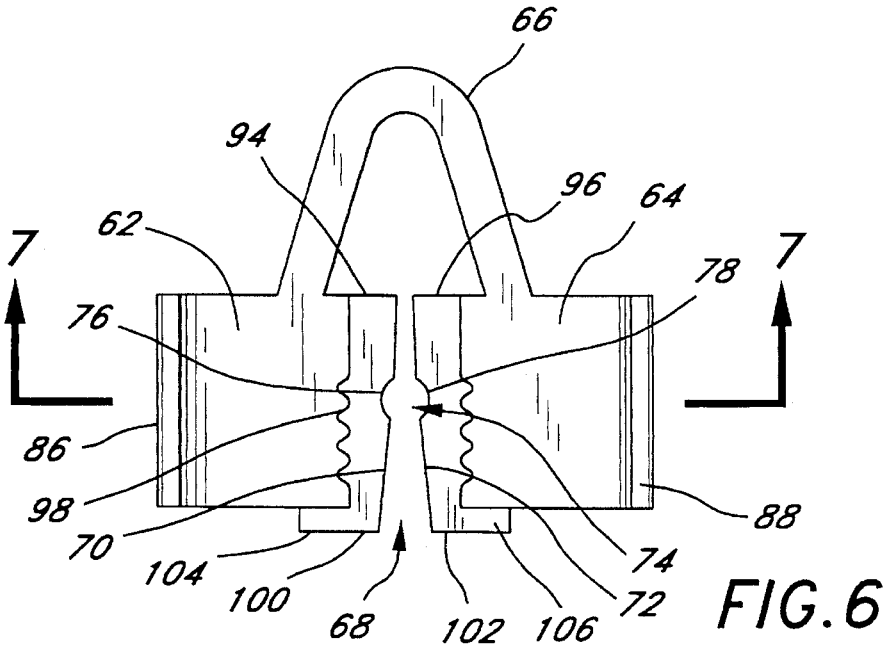
FIG. 6 is bottom plan view of the pivot block.
Figure 7:
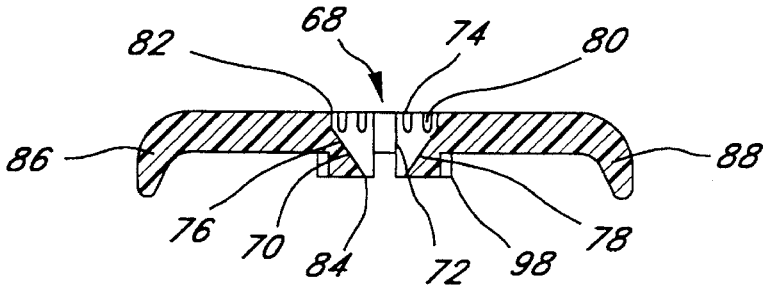
FIG. 7 is a cross-sectional view of the pivot block on line 7—7 of FIG. 6.

Referring to FIGS. 5 through 7, a frusto-conical socket 74 that varies in width is centered along gap 68 and is formed by two frusto-conical recesses 76 and 78. The recesses are positioned on the inside walls 70 and 72 of each block half 62 and 64, and align to create socket 74. Therefore, the width of the socket varies with the width of the gap. When the two block halves 62 and 64 are pinched together the width of the socket decreases.

As illustrated in FIG. 7, each recess has a top rim 82 and a smaller bottom rim 84. Positioned along the top rim of each recess 76 and 78 is a plurality of spaced serrations or grooves 80. The grooves 80 extend laterally or radially outward from the centers of the recesses 76 and 78.

Referring to FIGS. 1 and 5 through 7, the pivot block 22 also includes two side wings 86 and 88 on block halves 62 and 64, respectively. Each side wing is positioned on an outside wall of the pivot block 22 and is adapted to overhang an edge of the jamb bracket 20 as shown in FIG. 1. The outer edged side wings 86 and 88 depend to cover the raised edges 48 and 50 of the jamb bracket. The side wings are wider than the jamb bracket such that a space exists between the jamb bracket edges 48 and 50, and side wings 86 and 88. This allows pinching of the pivot block halves 62 and 64 when an inward pressure is exerted on each side wing 86 and 88. In addition, as illustrated in FIG. 1, side wings 86 and 88 have ribbed surfaces 90 and 92 to prevent slippage when pinching pivot block 22 or when guiding the pivot block horizontally along the jamb bracket.

FIGS. 5 and 6 illustrate the bottom surface of pivot block 22. Depending beneath the bottom surface of each block half are anchors 94 and 96 that extend the length of the block halves. Each anchor has a plurality of serrations 98 that extend laterally outward, complementary to serrations 56 on the jamb bracket 20 as shown in FIG. 1. When the pivot block rests in the jamb bracket slot 54, the serrations 98 on anchors 94 and 96 engage slot serrations 56. The vertical extent of the anchor serrations 98 is greater than the vertical extent of the slot serrations 56.

FIGS. 1, 5, and 6 also illustrate that two legs 100 and 102 depend from the forward end of the anchor of each block half. Each leg 100 and 102 aligns with the inside wall of each pivot block half and depends to the same vertical extent as the anchors. On the lower end of each leg is a foot, 104 and 106, that extends laterally outward and is adapted for insertion into the notches 58 and 60 on the jamb bracket 20 shown in FIG. 1. As shown in FIGS. 5 and 6, the lateral extent of the feet 104 and 106 is greater than the lateral extent of the anchor serrations 98. FIG. 1 illustrates that once the pivot block 22 is inserted into the jamb bracket 20 the feet 104 and 106 prevent accidental removal of the pivot block. Furthermore, the feet in combination with the side wings 86 and 88 help prevent twisting of the pivot block 22 within the jamb bracket 20 and also guide the pivot block horizontally along the jamb bracket.

Referring to FIG. 1, a tubular sleeve 24 adapted for mounting in a door 30 or a door corner block, and a pivot pin 26, have interengaging threads 108 such that the pivot pin is vertically adjustable relative to the door by rotation of the pivot pin 26 within the sleeve 24. Since the interengaging threads bear the weight of the door, adequate threading is required. In order to distribute the door weight among the interengaging threads 108, the threaded portion 118 of the pivot pin may be longer than the sleeve 24. The differing sizes allow the pivot pin 26 to extend below the door 30 for proper door alignment while still providing adequate threading to bear the weight of the door. The sleeve 24 has a ribbed outer surface 114 and an enlarged base 116. The ribbed outer surface 114 helps keep the sleeve 24 from rotating within the door 30. The enlarged base 116 keeps the sleeve from being inserted too far into a door. The sleeve 24 is made of plastic and is mounted to a bottom corner of a door.

Figure 2:
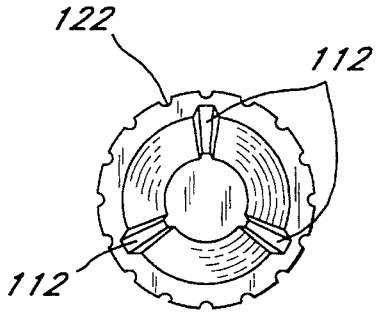
FIG. 2 is an end view of the pivot pin head on line 2—2 of FIG. 1.

As illustrated in FIG. 1, the lower end of the metal pivot pin has an enlarged rim 120 provided between the threaded portion 118 and an enlarged head 110. A number of small ribs 122 are formed around the periphery of the rim to facilitate grasping and rotating of the pivot pin by hand. The enlarged head 110 is conical and points downward so that the upper portion of the head is wider than the lower portion. In the preferred embodiment, the lower portion of the head is 0.185 inches in diameter and the upper portion is 0.48 inches in diameter. In addition, a plurality of splines 112 extend along the length of the head from the top to the bottom. In the preferred embodiment, only three splines 112 are provided, positioned 120 degrees from another, as shown in FIG. 2. The splines 112 are shaped to engage the serrated grooves 80 on the pivot block 22.

In operation, the jamb bracket 20 is mounted in a corner and the sleeve 24 and pivot pin 26 are installed in a door 30, as shown in FIG. 4. The pivot block 22 is inserted into the jamb bracket 20 and positioned for proper horizontal alignment. For vertical height, the pivot pin 26 is rotated within the sleeve 24 and then inserted into the socket 74 of the pivot block. The pivot pin 26 exerts a downward force that corresponds to the weight of the door. The conical shape of the pin head 110 and conical shape of the pivot block socket 74 translates the downward force generated by the weight of the door into lateral forces that expand the gap in the pivot block. The pivot block 22 expands to accommodate the pivot pin 26 and to firmly secure the anchors to the jamb bracket 20.

If it is desired to adjust the vertical height of the door, the door is lifted so that the pivot pin disengages from the pivot block. The pin can then be rotated a desired amount to raise or lower the door. The door is then lowered to reinsert the pivot pin into the pivot block.

If one desires to adjust the lower pivot assembly horizontally in order to align the door within the door jamb, one simply lifts the door until the pivot pin disengages the pivot block. The pivot block 22 is then positioned by pinching the side wings and sliding the pivot block to the proper location. Once released, the resilient connection 66 expands each block half until the anchors loosely engage the serrations 56 in the jamb bracket 20. The door is then lowered until the pivot pin engages the serrated grooves on the pivot block and block halves expand so that the anchors firmly engage the serrations 56 in the jamb bracket 20.

A primary advantage of the pivot block 22 is that if the closing of a door is blocked so that a lateral load is applied to the pivot pin 26, the pin cannot be readily moved laterally because the pin head 110 is still captured in the block. That is, the jamb bracket 20 prevents the block halves from spreading enough to allow the pin to escape the block. Thus, even though a lateral force on the tapered head and block can cause the pin and door to move up, the door must be lifted enough to allow the pin to be above the pivot block in order to escape the block. This takes considerable force, and usually there will not be enough clearance above the door to permit that.

An advantage of using only three splines 112 on the pin head 110, as shown in FIG. 2, is that three splines is not enough to prevent lateral movement of the door if the pin head is installed directly in the bracket 20. Thus, if an installer should forget to install the block 22, and places the pin head directly into the bracket, lateral movement of the pin will not be prevented, even if the pin head would otherwise mate properly with the bracket serrations. This would warn the installer that the block was not installed.

Although this invention has been described in terms of a certain preferred embodiment, other embodiments that are apparent to those of ordinary skill in the art are also within the scope of this invention.

What is claimed is:

1. A pivot block for a pivot assembly for pivotally anchoring a vertically oriented door, said block comprising:

two block halves;

a resilient connection at one end of the halves connecting the halves, but normally holding them spaced from each other by a slight gap, each of said block halves having a mating recess forming a portion of a socket for receiving the head of a pivot pin depending from a lower edge of said door, said pin head having exterior splines;

a plurality of grooves in each of the socket portions sized to receive the pivot pin splines; and an anchor depending from each block half and having a plurality of serrations extending laterally outward to mate with serrations in a slot in a mounting bracket to prevent movement of the block along the slot when the pin head, under the weight of the door, is pressed into said socket portions and urges said halves laterally outwardly.

2. The block of claim 1, wherein said connection is a V-shaped resilient portion.

3. The block of claim 2, wherein the connection is integral with the blocks.

4. The block of claim 1, wherein the recess formed along the inside edge of each block half forms half of a frustoconically shaped socket.

5. The block of claim 4, wherein the recess has a top rim larger than a bottom rim of the recess.

6. The block of claim 1, including a wing on the outer edge of each block half positioned above and spaced outwardly from said anchor and said serrations to facilitate gripping the block when initially positioning it or sliding it in a slot in a mounting bracket.

7. The block of claim 1, including a structure for interlocking said pivot block with a mounting bracket.

8. The block of claim 7, wherein said structure further comprises a foot from each anchor to be received in said slot and extend outwardly beneath the mounting bracket.

9. The pivot block of claim 1, wherein said pivot block is made of reinforced nylon.

10. The block of claim 1, in combination with a mounting bracket having a slot with serrations on lateral edges of said slot, and a pivot pin to be positioned in a lower edge of a door and having a head to be positioned in said socket.

11. A combination comprising:

a vertically oriented door;

a pivot pin vertically mounted in a lower edge of the door, the pin having a frusto-conically shaped head on its lower end extending below the door;

a mounting bracket to be mounted in a door frame beneath said door, said bracket having a slot with serrations on side edges; and a pivot block including two block halves spaced from each other by a slight gap;

each block halve having a depending anchor which fits within said slot;

each of said block halves having an upper portion which rests on said bracket;

a resilient connection joining one end of each half and holding the halves spaced by said gap, but permitting said halves to be pressed into mating engagement with each other, each of said block halves having a recess forming a portion of a socket, positioned to receive the head of said pivot pin;

a plurality of grooves in each of the socket portions to mate with splines on the pin head; and a plurality of serrations formed on outer surfaces of said anchors which mate with the serrations on said bracket when the weight of said door causes the head of said pin to urge the block halves outwardly and thereby capture the block in the slot and prevent the block, together with the pin and the door from moving along said slot, the pin head being larger than the gap between the block halve portions forming the socket when the anchor serrations engage the bracket serrations so that the pin head cannot pass through the socket.

12. The combination of claim 11, wherein said anchor includes a leg with an outwardly extending foot on each leg to retain vertically the block in the bracket.

13. The pivot block of claim 11, wherein the recess formed along the inside edge of each block half forms half of a frusto-conically shaped socket with a top rim of the recess larger than a bottom rim.

14. The combination of claim 11 wherein said block upper portions extend over the upper surface of said bracket and depend over side edges of the bracket.

15. A lower pivot assembly for a folding door comprising:

a jamb bracket connectable in a corner between a door jamb and the floor, said jamb bracket containing an elongated slot extending parallel to the floor when the bracket is mounted to the floor, the slot having a pair of spaced elongated sides;

a plurality of serrations along each elongated side of said slot and extending laterally inwardly towards each other;

a pivot block having two spaced halves resiliently connected at one end, said halves forming a socket;

an anchor depending from each block half, and having a plurality of serrations extending laterally outward mating with said slot serrations;

a pivot pin for connection to each door in a manner to adjust door height; and an enlarged, generally conical head on the lower end of the pin, the lower portion of said head being narrower than the upper portion, said head having a plurality of splines extending along the length of said head to engage grooves in said socket and exert vertical and lateral forces on said pivot block halves, said pivot block halves being separated by a gap to accommodate said pin head and to cause the plurality serrations on each anchor to engage the serrations on the bracket slot to prevent translation of the pivot block along the slot and to prevent the pin head from passing through the socket.

16. The assembly of claim 15, wherein the two halves of said pivot block are connected with a generally V-shaped resilient portion.

17. The assembly of claim 15, wherein the block halves including said connection are formed as a one piece plastic unit.

18. The assembly of claim 15, wherein said jamb bracket includes flanged edges along a portion parallel to the floor, said flanged edges curve downward to provide a space beneath the bracket to accommodate said anchors.

19. The assembly of claim 18, wherein each elongated side of said jamb bracket slot has a notch.

20. The assembly of claim 19, further comprising a leg depending from each block half, each leg having a foot that extends laterally outward to interlock with said jamb bracket by insertion into said notch.

21. The assembly of claim 15, comprising a side wing formed on the outside edge of each block half whereby said side wings straddle said bracket and prevent twisting of said pivot block.

22. The assembly of claim 15, wherein said gap is smaller than the diameter of said pin head so that the pin head is captured in said socket to prevent lateral movement of the pin, unless the pin is raised above said socket.

* * * * *